United States Patent [19]

Knight et al.

[11] 4,159,554

[45] Jul. 3, 1979

[54] FABRIC CLEANING HAND TOOL WITH RECIRCULATING SYSTEM

[76] Inventors: Arlen M. Knight, 1141 N. Patterson; William R. Hachtmann, 5072 Walnut Park Dr., both of Santa Barbara, Calif. 93111

[21] Appl. No.: 794,353

[22] Filed: May 6, 1977

[51] Int. Cl.[2] ..... A47L 7/00; A47L 11/34

[52] U.S. Cl. ..... 15/321; 222/318; 239/124

[58] Field of Search ..... 15/321, 322; 222/318; 239/124

[56] References Cited

U.S. PATENT DOCUMENTS

| | | | |
|---|---|---|---|
| 1,929,345 | 10/1933 | Brown et al. | 15/321 |
| 2,757,406 | 8/1956 | Decker | 15/321 |
| 2,996,743 | 8/1961 | Noble | 15/321 X |
| 3,431,582 | 3/1969 | Grave | 15/321 |
| 3,538,535 | 11/1970 | Ginsburgh et al. | 15/322 X |
| 3,812,552 | 5/1974 | Blackmon | 15/321 |

FOREIGN PATENT DOCUMENTS

| | | | |
|---|---|---|---|
| 584806 | 10/1959 | Canada | 15/321 |

*Primary Examiner*—Christopher K. Moore
*Attorney, Agent, or Firm*—Ralph B. Pastoriza

[57] ABSTRACT

A recirculating system is provided for use with a cleaning machine including a recovery tank and a heated fluid solution dispensing tank for recirculating a part of the heated fluid passed from the dispensing tank to a hand-held fabric cleaning head. A normal vacuum hose connects a suction chamber in the hand-held cleaning head to the recovery tank of the machine. A dispensing fluid outlet line and a dispensing fluid return line are both preferably contained within the vacuum hose. The ends of the fluid inlet line and fluid outlet line at the machine extend laterally through appropriate fixtures from the vacuum hose to outlet and return inlet ports of the fluid dispensing tank. The far distal ends of the fluid outlet line and fluid inlet line at the hand-held head in turn connect to a block member having a third outlet for passing a portion of the dispensing fluid directly to a spray nozzle in the outlet head. The block structure is arranged to pass another part of the fluid back through the inlet line to the dispensing tank so that continuous recirculation takes place and the fluid dispensed from the nozzle is maintained in a heated condition.

3 Claims, 4 Drawing Figures

FABRIC CLEANING HAND TOOL WITH RECIRCULATING SYSTEM

This invention relates generally to hand-held fabric cleaning tools and more particularly to a combination hand-held fabric cleaning tool and recirculating system for cleaning fluid dispensed from the hand-held tool.

BACKGROUND OF THE INVENTION

In our copending patent application Ser. No. 640,493 filed Dec. 15, 1975 and entitled *HAND TOOL FOR CLEANING FABRIC* there is disclosed a hand held head structure connected by a vacuum hose to the recovery tank of a cleaning machine. This cleaning machine further includes a fluid solution dispensing tank for passing fluid to the head through a fluid line within the vacuum hose. The end of the fluid line at the machine extends through a sealed fixture outside the vacuum hose to connect to the fluid dispensing tank. The other end of the fluid line at the hand held head similarly passes through a sealed fixture from the head to a flow control valve and thence back into the head to a nozzle in a nozzle spray chamber adjacent to the suction chamber.

As described in the aforesaid pending patent application, heated fluid is passed through the fluid line and out the spray nozzle while suction is taking place to thereby work up dirt and debris in the upholstery so that the upholstery is cleaned and such debris is removed through the vacuum hose.

Successful cleaning with a hand-held tool as described above depends, to a considerable extend, on providing the cleaning solution at a high temperature when it is dispensed from the spray nozzle in the head onto the fabric. This heat is very important in working loose the dirt and other debris in the fabric itself. While the cleaning solution is maintained at a sufficient temperature for cleaning purposes in the fluid dispensing tank of the machine, by the time it travels down the fluid line within the vacuum hose to the head, a substantial cooling has taken place. In fact, there can exist a 30° F. drop in the temperature of the fluid at the head as compared to the temperature of the fluid when it initially leaves the fluid dispensing tank of the machine.

BRIEF DESCRIPTION OF THE PRESENT INVENTION

With the foregoing in mind, the present invention contemplates the provision in combination with a hand-held fabric cleaning head of a recirculating system for the cleaning fluid functioning in a manner to maintain the temperature of the heating fluid at the hand-held head close to its temperature in the dispensing tank of the machine.

More particularly, in accord with the invention, a fabric cleaning hand tool is provided with recirculating system for use with a cleaning machine including a recovery tank and a heated fluid solution dispensing tank, comprising, in combination a hand-held structure defining in its interior a suction chamber and an adjacent spray nozzle.

A vacuum hose has one end connected to the head in communication with the suction chamber and its other end extending to the recovery tank. A fluid inlet line connects at one end to the fluid dispensing tank and runs longitudinally within the vacuum hose. Similarly, a fluid outlet line connects to a return inlet to the dispensing tank and runs longitudinally within the vacuum hose.

The far ends of the outlet line and inlet line connect to a block member secured to the hand-held tool, this block member having a nozzle connection outlet. Essentially, the block member places the far outlet of the outlet fluid line in communication with the far inlet of the inlet fluid line and also in communication with the nozzle. The dimensioning of the various openings of the inlet, outlet and nozzle connection lines is such that a portion of the heated fluid is returned by the inlet line to the dispensing tank and another portion passes directly to the nozzle when the tool is operated. Continuous circulation of the heated fluid thus takes place between the dispensing tank and the hand-held head so that the solution dispensed from the head is maintained in a heated condition.

With the foregoing arrangement, it is found that any temperature drop of the fluid dispensed from the head from the temperature of the fluid in the dispensing tank is only approximately 2°. As a consequence, a far more effective fabric cleaning job can be achieved because of the high temperature of the cleaning fluid.

BRIEF DESCRIPTION OF THE DRAWINGS

A better understanding of this invention will be had by referring to a preferred embodiment as illustrated in the accompanying drawings in which.

DETAILED DESCRIPTION OF THE PREFERRED EMBODIMENT

Figure 1:
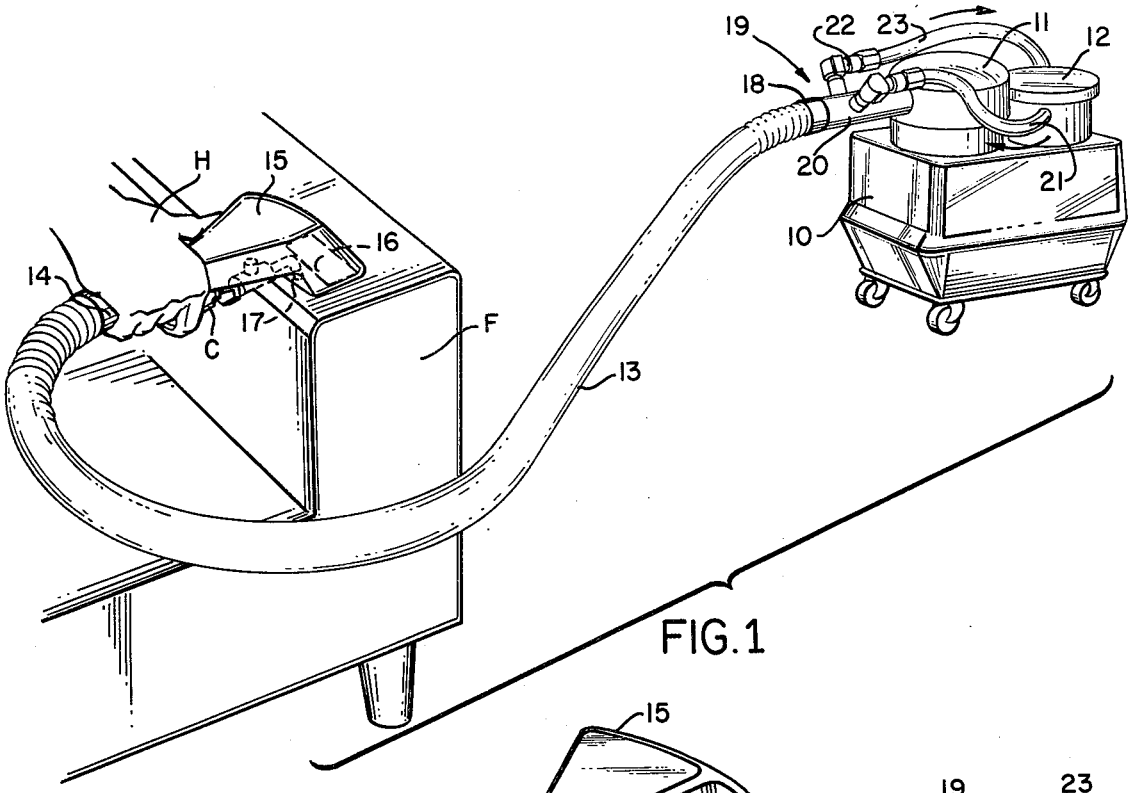
FIG. 1 is a perspective view of a cleaning machine connected by way of a vacuum hose to a hand held tool for cleaning fabric or similar upholstery incorporating the recirculating system of this invention.

Referring first to FIG. 1 there is shown a cleaning machine 10 including a recovery tank 11 and a heated fluid solution dispensing tank 12.

A vacuum hose 13 has one end cuff portion 14 connected to a hand-held cleaning tool 15 incorporating a suction chamber 16 in its interior and an adjacent spray nozzle 17 as indicated by the phantom lines. The other end of the vacuum hose 13 terminates in a cuff 18 connecting to a swivel structure 19 and thence to the recovery tank 11. As indicated in FIG. 1 a portion of the connecting structure of the swivel 19 to the recovery tank 11 includes a fluid inlet fixture 20 connected by line 21 to the fluid dispensing tank 12 and a fluid outlet fixture 22 connected by line 23 to a return inlet to the fluid dispensing tank 12.

It is to be understood that cleaning fluid in the fluid tank 12 is maintained in a heated condition close to the boiling point of water and is caused to pass to the inlet fixture 20 and have a portion returned from the outlet fixture 22 by an appropriate pump.

As will become clearer as the description proceeds, there are provided fluid inlet and fluid outlet lines running longitudinally within the vacuum hose 13 connecting respectively to the inlet and outlet fixtures 20 and 22 at the ends of these lines passing to the machine 10. The other ends of these lines within the vacuum hose 13 communicate with the spray nozzle 17 in the head 15. Essentially, a portion of the heated cleaning fluid is recirculated by the fluid inlet and outlet lines within the vacuum hose 13, another portion passing directly to the nozzle 17 in the head 15 for cleaning appropriate fabric or upholstery such as indicated at F in FIG. 1.

Figure 2:
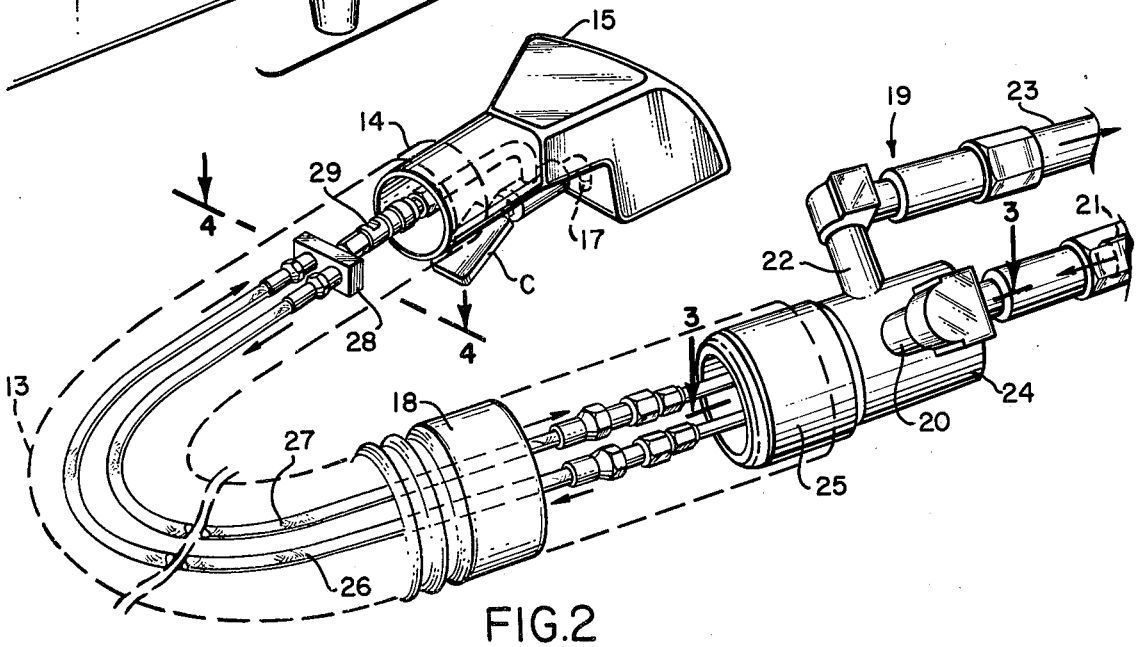
FIG. 2 is an enlarged perspective view partly in exploded form of the principal components making up the recirculating system of FIG. 1.

All of the foregoing will become clearer by now referring to the detailed showing of FIG. 2. Considering first the swivel coupling 19, briefly described in FIG. 1, it will be noted that this structure includes a stationary sleeve 24 which extends from the recovery tank 11. A collar 25 is rotatably mounted on a reduced diameter forward portion of this sleeve 24 and is arranged to receive an end defined by the cuff 18 of the vacuum hose 30 shown exploded away from the collar 25.

The inlet and outlet fixtures 20 and 22 are shown circumferentially spaced and radially extending from the stationary sleeve 24 for connection to the lines 21 and 23 respectively as described in FIG. 1. The appropriate pump heretofore referred to is schematically indicated at P with an inlet and outlet 23' and 21' connected to the lines 23 and 21 respectively. The radially inwardly extending portions of the fixtures 20 and 22 connect to fluid inlet and outlet lines indicated at 26 and 27 which run longitudinally within the vacuum hose 13.

Referring now to the hand-held head structure shown in FIG. 2, it will be noted that the distal ends of the fluid inlet and outlet lines 26 and 27 connect to a block member 28. This block member 28 includes a nozzle connecting bore to which a swivel 29 is secured, the outlet of the swivel in turn passing radially from the neck portion of the head 15 to an appropriate control valve C and thence to the spray nozzle 17 back in the head structure 15. The flow control C and remaining portion of the neck and head structure may be substantially the same as that described in our heretofore referred to copending application.

It will be understood in FIG. 2 that the fluid inlet and outlet lines 26 and 27 within the vacuum hose 13 and the block member 28 along with the stationary sleeve 24 and inlet and outlet fixtures 20 and 22 all remain rotationally stationary. On the other hand, because of the swivel collar 25 for the swivel coupling 19 to the recovery tank and the swivel 29 on the far side of the block member 28 in the neck portion of the head 15, the head and neck 15 along with the flow control C and vacuum hose 13 may all rotate. Twisting of the vacuum hose is thus prevented.

Figure 3:
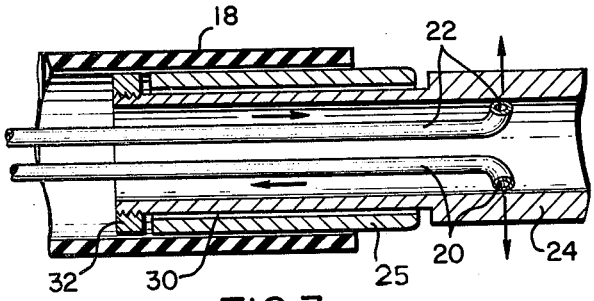
FIG. 3 is a fragmentary cross section taken in the direction of the arrows 3—3 of FIG. 2; and, FIG. 4 is an enlarged fragmentary cross section taken in the direction of the arrows 4—4 of FIG. 2.

FIG. 3 illustrates further details of the swivel coupling 19 wherein it will be noted that the sleeve 24 includes at its forward end a reduced diameter portion 30 receiving the rotatable collar 25. In FIG. 3, the cuff end 18 of the flexible vacuum hose is shown received over the collar and it will be evident that it can swivel by rotating with the collar in the reduced diameter portion 30 which essentially defines an exterior annular channel. To prevent axial movement of the collar 25 from the end of the sleeve, an end ring 32 may be provided and secured as by welding or threaded engagement to complete the channel structure. 20 and 22 are visible in FIG. 3, these respective structures turning from their radial inward directions to directions longitudinal of the sleeve and vacuum hose to connect to the fluid inlet and fluid outlet lines 26 and 27 depicted in FIG. 2 respectively.

Figure 4:
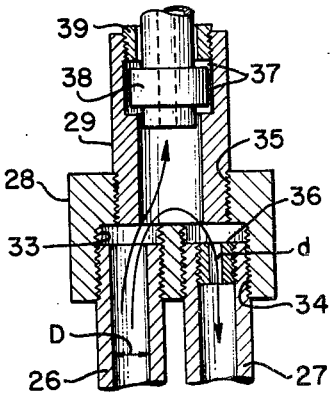

Referring now to the cross section of FIG. 4, further details of the block member 28 described in FIG. 2 will be evident. As shown, the block member 28, which is secured in the head within one end of the vacuum hose, has a fluid inlet bore 33 connected to the fluid inlet line 26, a fluid outlet bore 34 connected to the fluid outlet line 27, and a nozzle connection bore 35 communicating with both the inlet bore 33 and outlet bore 34 and also arranged to eventually communicate with the spray nozzle through the swivel structure 29.

In accord with an important feature of this invention, there is provided a means in the form of an exteriorally threaded member 36 received in tapped opening in the end of the fluid outlet line 27. This member includes a central bore having a diameter d which is between one half and one fourth the diameter D of the opening of the fluid inlet line 26. Thus there is provided a reduced diameter outlet opening for recirculating a part of the heated fluid passed on the fluid inlet line 26 to the block 28. The remaining portion of the heated fluid passes eventually to the nozzle through the swivel 29.

The swivel 29 itself may be of any well known type. In the particular embodiment shown in FIG. 4, it is formed by a short section of pipe having an internal channel 37 defined therein for cooperation with an increased diameter portion 38, an end ring 39 being provided to prevent axial removal of the enlarged portion 38 from the channel 37. Rotation of the enlarged portion 38 and corresponding tube can thus take place.

It will be understood that the outlet of the swivel 29 extends laterally from the neck portion of the head 15 to the flow control valve C as shown in FIG. 2 and thence from this external flow control valve back into the head structure 15 to the spray nozzle 17. As stated, this portion of the head structure may be identical to the fabric cleaning head described in our referred to copending application from further description is not deemed necessary.

OPERATION

In operation, the hand held head 15 is simply moved over a fabric to be cleaned such as the fabric F shown in FIG. 1 with the machine 10 in operation. An appropriate vacuum is drawn on the vacuum hose 13 to suck up all debris and the like in the suction chamber 16 of the head passing the same back through the vacuum hose 13 to the recovery tank 11. Simultaneously, fluid from the fluid dispensing tank 12 passes into the inlet fixture 20 and inlet fluid line 26 to the block structure 28.

With specific reference again to FIG. 4, a part of this fluid passes back through the fluid outlet line 27 to the fluid dispensing tank 12 by way of the outlet fixture 22 as described in FIG. 1. The remaining portion of the heated fluid passes through the swivel 29 and control valve C to the spray nozzle 17 when the control valve C is opened.

From the foregoing, it will be evident that continuous circulation of the fluid takes place whether or not the flow control C is opened or closed. This recirculation assures that the fluid adjacent the head portion of the hand held tool is always in a heated condition corresponding closely to the temperature of the fluid in the dispensing tank 12 of the machine 10.

Proper proportioning of the fluid outlet opening defined by the reduced diameter bore d as described in FIG. 4 relative to the inlet diameter D of the inlet line 26 is important. If the reduced diameter bore d is too small sufficient circulation will not take place to provide optimum heating of the dispensed fluid at the head. On the other hand, if this reduced diameter bore is too large resulting in a very large amount of recirculation, pressure is lost at the head for the spray jet nozzle. Moreover, if too much circulation takes place, more heating is required at the tank. In other words, with too much circulation, the fluid is not in contact with the heater in the tank long enough to be sufficiently heated for a heater of given capacity. Also, the fast circulation increases the heat exchange between the fluid in the lines and the exterior thereby causing heat loss. Thus in both instances whether the reduced opening is too small or too large, more heating is required. The optimum arrangement results when the fluid outlet reduced diameter bore is, as stated, between one half and one fourth the fluid inlet diameter D.

In an actual embodiment with the nozzle on, about one pint per minute of heated water with appropriate detergents and emulsifiers is passed from the nozzle. The inlet diameter D under these circumstances is approximately 8/64 of an inch and the reduced diameter d is 3/64 of an inch.

From all of the foregoing, it will be evident that the present invention has provided a greatly improved fabric cleaning hand tool wherein more efficient cleaning action is realizable by means of the circulating system which assures that the cleaning fluid dispensed from the head is maintained at an optimum temperature for maximum cleaning.

We claim:

1. A fabric cleaning hand tool with a recirculating system for use with a cleaning machine including a recovery tank, a heated fluid solution dispensing tank and a pump having an inlet and outlet in said dispensing tank for recirculating fluid solution, comprising, in combination:

(a) a hand-held head structure defining in its interior a suction chamber and an adjacent spray nozzle;

(b) a vacuum hose having one end connected to said head in communication with said suction chamber and its other end extending to said recovery tank;

(c) a dispensing fluid inlet line connecting to the outlet of said pump in said fluid solution dispensing tank and a fluid outlet line connecting to the inlet of said pump to return said fluid solution to said dispensing tank so that fluid is circulated by said pump in said tank; and, (d) a member secured to said head connecting to said fluid inlet line and said fluid outlet line and to said spray nozzle so that a portion of heated fluid passing through said fluid inlet line is continuously recirculated back through said member and said fluid outlet line to said fluid dispensing tank and another portion is passed to said nozzle, when said nozzle is operated whereby the portion of fluid passed to said nozzle is maintained in a heated state as a consequence of the recirculation of the said first mentioned portion of fluid.

2. A fabric cleaning hand tool with a recirculating system for use with a cleaning machine including a recovery tank, a heated fluid solution dispensing tank and a pump having an inlet and outlet in said dispensing tank for recirculating fluid solution, comprising, in combination:

(a) a hand-held structure defining in its interior a suction chamber and an adjacent spray nozzle;

(b) a vacuum hose having one end connected to said head in communication with said suction chamber and its other end extending to said recovery tank;

(c) a swivel connection between said other end and said recovery tank, said swivel connection comprising a stationary sleeve having a reduced diameter portion defining an external annular channel at its forward portion; a collar rotatable in the channel receiving said other end of said vacuum hose, the rear portion of said sleeve having a dispensing fluid inlet fixture radially extending thereinto connected to the outlet of said pump and a circumferentially spaced dispensing fluid outlet fixture radially extending thereinto connected to the inlet of said pump;

(d) a fluid inlet line running longitudinally within said vacuum hose and sleeve to connect to said fluid inlet fixture and a fluid outlet line running longitudinally in said vacuum hose and sleeve connecting to said fluid outlet fixture;

(e) a block member secured to said head within said one end of said vacuum hose, said block member having a fluid inlet bore connected to said fluid inlet line, a fluid outlet bore connected to said fluid outlet line, and a nozzle connection bore communicating with said inlet bore and said outlet bore and communicating with said spray nozzle;

(f) a swivel means connected between said nozzle connection bore and spray nozzle, for permitting swivelling of said spray nozzle relative to said block member;

(g) a flow control connected between said swivel means and said spray nozzle, and (h) means reducing the diameter of the outlet opening into said outlet line at said outlet bore to a value from one half to one fourth the diameter of the inlet opening of the inlet line at said inlet bore in said member whereby recirculation of a portion of heated fluid between said hand tool and said dispensing tank continuously takes place to thereby decrease loss of heat of the portion of the fluid passed to said nozzle.

3. The subject matter of claim 2, in which the outlet opening into said outlet line is tapped, said means reducing the diameter of said outlet opening comprising an externally threaded body receivable in said tapped outlet opening having a central bore therethrough defining said reduced diameter.

* * * * *